United States Patent [19]

Jordan

[11] 3,968,899

[45] July 13, 1976

[54] EASY-OPEN CONTAINER WALL AND APPARATUS

[75] Inventor: Charles L. Jordan, Pittsburgh, Pa.

[73] Assignee: Aluminum Company of America, Pittsburgh, Pa.

[22] Filed: June 20, 1975

[21] Appl. No.: 588,633

Related U.S. Application Data

[62] Division of Ser. No. 451,191, March 14, 1974.

[52] U.S. Cl. ..... 220/266; 113/15 A

[51] Int. Cl.[2] ..... B21D 51/38

[58] Field of Search..... 72/325; 113/15 A, 121 C, 113/1 F; 220/265, 266

[56] References Cited

UNITED STATES PATENTS 3,848,557 11/1974 Holk ..... 113/15 A

FOREIGN PATENTS OR APPLICATIONS 1,164,179 9/1969 United Kingdom..... 113/15 A

*Primary Examiner*—Lowell A. Larson

*Attorney, Agent, or Firm*—Patrick J. Viccaro; Arnold B. Silverman

[57] ABSTRACT

A method of scoring and a scoring tool which enables the scoring of laminated metallic container walls with a wide range of scoring indenter working face widths and which also enables the scoring of conventional and non-repair coated metallic container ends to thin residuals with a narrow, typically about 0.001 inch working face width, indenter. The method essentially consists of applying a compressive force between the principal score line and the wall periphery such that the force is closely spaced to and substantially coextensive with the score. This compressive force may conveniently be applied by a second scoring indenter having a lesser penetration depth than the primary score indenter.

The scored container wall produced by the above described method of scoring and the scoring tool.

9 Claims, 9 Drawing Figures

PRIOR ART

PRIOR ART

EASY-OPEN CONTAINER WALL AND APPARATUS

This is a division of application Ser. No. 451,191, filed Mar. 14, 1974.

BACKGROUND OF THE INVENTION

Since the advent of the easy open container, it has become well known to provide a container wall with a removable or partially removable panel portion. The panel portion is outlined or defined by a primary score line which facilitates severance from the balance of the container wall. This severance may be initiated and propagated by the use of an appliance integral with the removable panel such as a tab or pull tab. A typical type ring tab appliance is described in U.S. Pat. No. 3,349,949. In some cases the openable portion is completely severed from the container while in other cases severance is partial, i.e. only to the extent necessary to permit the desired access to the container interior.

It was frequently found desirable in score line configurations allowing severance of an entire panel or wall and in certain other score line configurations to provide a second score line of lesser depth than the primary score line. This score line, commonly referred to as an "anti-fracture score", is believed to affect the residual stresses associated with the primary score so as to prevent microcracks in or premature fracture along this primary score from container wall handling during manufacture, transport, storage, and use. This concept is more fully described in U.S. Pat. No. 3,406,866 and British Pat. No. 1,164,179. The typical spacing therein disclosed between the centerlines of the primary and anti-fracture scores is in the range of 0.050 to 0.125 inch with a spacing of 0.080 inch indicated as preferred. In container walls having the so-called "full panel" removable sectors and other configurations in which the primary score is closely adjacent to a can end chuck wall, this spacing requires that the anti-fracture score be disposed inboard of the primary score, i.e. the primary score is between the wall periphery and the anti-fracture score.

These prior art anti-fracture score configurations, however, do not provide an adequate solution for many problems posed by new developments in the packaging arts.

The development of laminated container walls having a bonded secured film of such properties as to withstand scoring and rivet forming forces without fracture or excess thinning has provided a significant advance in the art which allows the packaging of many products previously too corrosive for packaging in easy open containers. This improvement has made it desirable to exercise greater control of metal flow during scoring. Although these laminates maintain integrity in layers adhered to the sheet metal container wall, upon scoring, the laminate configuration may tend to create difficulties in metal flow during the scoring operation unless care is exercised. In particular the presence of the laminate layers appears in some manner to promote the tendency for non-uniform metal flow in a direction generally transverse to the score line during scoring. Such non-uniform metal flow may increase the susceptibility of the primary score line to microcracks or premature fracture during manufacture, transport, storage, handling or use.

Better control of metal flow during scoring is also a highly desirable objective in non-repair coating systems employed in full panel easy open ends. In the non-repair coating system the protective coating applied to the undersurface of the container wall to be scored is of such a nature that it survives the severe strain conditions encountered beneath the score line during scoring, whereas in conventional varnished coatings the coating is often fractured by the scoring operation. The non-repair systems were originally developed for beverage containers having integral opening devices. However, in full panel ends it is often desirable to have thinner score residuals than have been typical in the beverage environment in order to facilitate opening of the container. The mechanics of opening allow the beverage score line to have a thicker residual without requiring an objectionable amount of force to open. Also in some cases thicker residuals were desirable in beverage containers because the contained beverage might develop significant internal pressure, such as in the case of carbonated beverages.

However, scoring to a thinner residual may increase the probability of score line fracture or microcracking during the scoring operation. One way to minimize this tendency in conventional coating systems is to use a wide, typically about 0.004 inch, working face scoring tool. But this option is not practical in a non-repair coat system because the wider the tool face the greater the chance of damaging the non-repair coating during scoring. It is typical to use a narrow tool, about 0.0015 inch to 0.0020 inch face width, with a non-repair coating system. Thus there is the problem of providing for the thin residuals necessary for ease of opening with the narrow tool required to preserve the non-repair coating and yet maintaining score line integrity. It is believed that the prior art provides no answer to this dilemma.

The use of conventionally coated (varnished) easy open ends in mildly corrosive environments such as fish cans has posed yet another problem. In these environments corrosion occurs along the score lines of the ends causing microperforation of the end. It is believed that this corrosion is promoted by the severe grain distortion which occurs under the normal width indenter, typically about 0.004 inch wide. This grain distortion is a reflection of the metal flow caused by the indenter and will be discussed in more detail hereinafter. The apparent solution would be to score with a narrow indenter and thus minimize such grain distortion. However, as noted with reference to the non-repair coating system, the prior art does not provide any method of scoring to thin residuals with a narrow indenter.

SUMMARY OF THE INVENTION

This invention has solved the above described problems. It provides a method of scoring and a scoring tool wherein container walls with or without a non-metallic layer of substantial thickness adhered thereto, e.g. laminated container walls, may conveniently be scored to produce a primary score line having an acceptably low susceptibility to microcracking or premature fracture. In addition it provides for scoring to suitable residuals with a narrow, typically about 0.0005 inch to 0.0020 inch face width, tool without score line fracture, thereby facilitating the use of full panel easy open ends in non-repair coating systems and in mildly corrosive environments, such as fish cans. A compressive force is applied to the container end to be scored on the outboard or preferably on both sides of the primary score. As used herein, "outboard" is a comparative term meaning closer to the periphery of the container end or wall than is the reference and "inboard" is the opposite term meaning farther from the periphery than the reference. This compressive force is applied substantially coextensively with the primary score and sufficiently close to the primary score to have a beneficial effect on the metal flow resulting from the primary scoring, typically within about 0.040 inch of the center of this score, and preferably within about 0.025 inch or less. This compressive force may be applied during the primary scoring operation before the primary indenter has penetrated to about 50% of its ultimate penetration. A preferred method of applying such a compressive force is with a scoring indenter adapted to have significantly less penetration than the primary scoring tool to no more than about 75% of the ultimate penetration of the primary scoring tool. Additional benefit is obtained if the included angle of the primary and any secondary scoring tools are minimized in order to minimize metal flow (or displacement) and a typical such angle is about 50° to 60°.

This invention also encompasses the scored container wall produced by this method of scoring and by the use of this scoring tool.

It is an object of this invention to provide a method of and apparatus for scoring container walls having substantial thicknesses of non-metallic elements adhered thereto such that the score line produced will have an acceptably low susceptibility to microcracks or premature fracture.

It is another object of this invention to provide a method of scoring such walls to desired residuals of less than about 0.005 inch without causing fracture during scoring.

It is also an object of this invention to provide a method of scoring conventional and non-repair coated container walls with a narrow tool to residuals of less than about 0.005 inch with acceptable score line integrity.

It is a further object of this invention to provide a method of scoring a can end such that a secondary score may be placed outboard of a primary score which is closely adjacent to the chuck wall of the end.

These and other objects of this invention will be more clearly understood by reference to the detailed description and the drawings appended hereto.

DESCRIPTION OF PREFERRED EMBODIMENTS

For convenience the term "removable sector" is defined to mean a portion of a container wall bounded or partially bounded by a primary score line in such a way as to facilitate the complete or partial severance of the removable sector from the remainder of the wall, so that such severance will provide access to the contents of the container.

Figure 1:
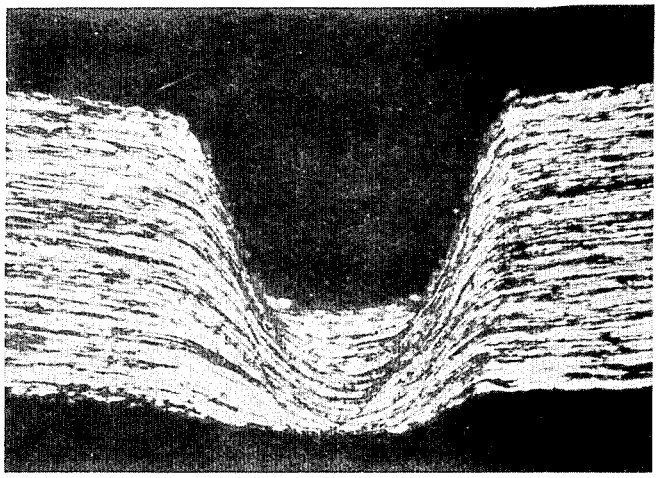
FIG. 1 PRIOR ART
FIG. 1 is a photomicrograph of a vertical section through a primary score line in a laminated container end made with a tool of the type described in British Pat. No. 1,164,179 which establishes two anti-fracture scores.
Figure 2:
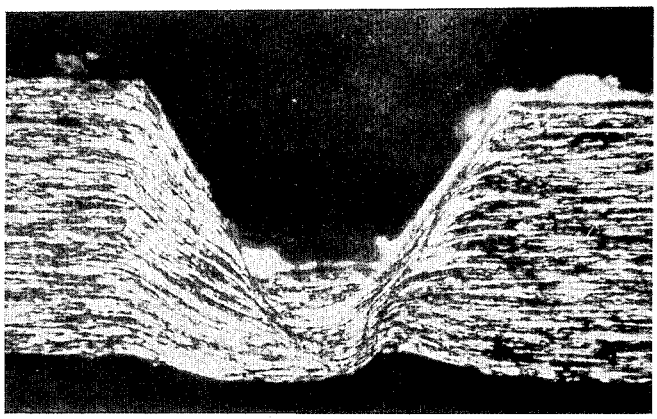
FIG. 2 is a photomicrograph of a vertical section through a primary score line in a laminated container end made with a single prior art anti-fracture score line.

The scoring of laminated container wall material by certain prior art indenters may cause a certain degree of unsymmetric and undesirable metal flow as illustrated in FIGS. 1 and 2. In both FIGS. 1 and 2 the periphery of the container end is to the viewer's right. In both cases disproportionately high metal flow towards the periphery of the end has resulted, causing a severe stress raiser directly below the outboard corner of the score trough. In FIG. 2, an anti-fracture score was made simultaneously with the primary score with its centerline at a distance of about 0.055 inch inboard of the centerline of the primary score. In FIG. 1 anti-fracture scores were made on both sides of the primary score with their centerlines at a distance of about 0.060 inch to 0.080 inch from its centerline. In both cases the anti-fracture scoring tools began penetration after the primary scoring tool had achieved about one half of its total penetration. In neither case was the presence of the anti-fracture scoring able to control the metal flow at the primary score to produce the desired uniformity and symmetry of metal flow. The unsymmetric metal flow is believed to have resulted from the lack of restraint to metal flow in the direction of the end periphery. Such a metal flow pattern is undesirable because it causes the score line to have questionable integrity during manufacture, transport, storage, handling and use. This is especially so in the case of aluminum container walls of 0.010 inch nominal thickness wherein a desirable residual beneath the primary score may be about 0.004 inch.

Figure 3:
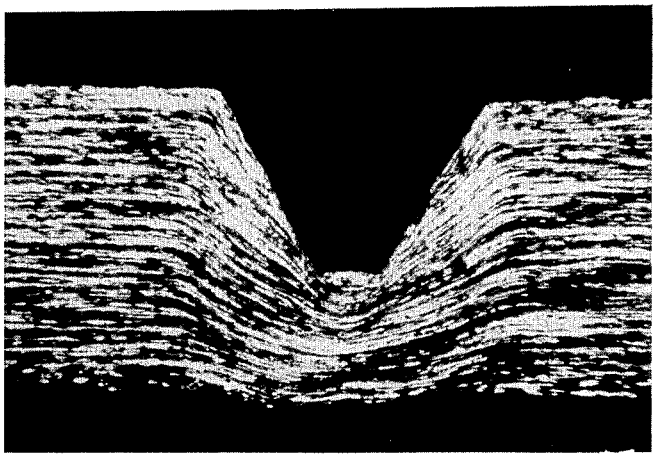
FIG. 3 is a photomicrograph of a vertical section through a primary score line in a laminated container end made by the present invention.

FIG. 3 illustrates effective manner in which the use of the present invention has obviated these prior art difficulties. The metal flow is uniform and symmetric about the primary score trough. The score line illustrated has dependable integrity.

Figure 4:
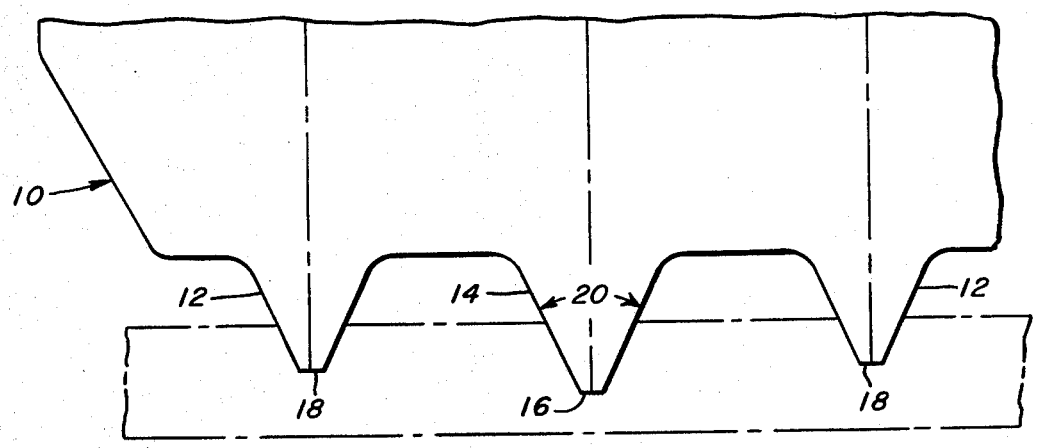
FIG. 4 is a schematic vertical section of a scoring tool configuration that is used in the practice of the present invention with laminated container ends.

FIG. 4 illustrates a form of tooling 10 which may be used to produce the score line shown in FIG. 3. Two anti-fracture score indenters 12 are each spaced approximately 0.025 inch (centerline to centerline) from the primary indenter 14. The three indenters are circular in plan, and centerlines and spacings are defined in a traverse plane containing a diameter of the concentric circles formed by the indenters. The tool is preferably so designed that these secondary indenters will begin penetration after the primary indenter has achieved a penetration of about 0.0025 to 0.0030 inch. In the scoring of nominal 0.010 inch thick aluminum container ends being scored to a primary score line residual of 0.004 inch, the secondary indenters will begin penetration when the primary indenter has achieved less than about ½ of its total penetration. The primary indenter has an included angle 20 between its sidewalls of about 50° to 60° and a face width 16 of about 0.0025 inch to 0.0030 inch. Each of the secondary indenters 12 has a face 18 of width of about 0.0025 inch to 0.0030 inch.

In the practice of the invention it is preferred to cause as little metal flow as possible during the scoring operation. Thus it is preferred to use a sharp narrow primary indenter such as that illustrated. However, while it is known to use indenter included angles of 30° to 90° and while the present invention may be used with indenters having such included angles, because of difficulties encountered at both extremes of this range in conventional scoring, it is preferred to use an indenter with an included angle of about 50° to 60°. In addition, it may be found desirable to have some minimum indenter face width in order to facilitate improved rupture characteristics of the laminate film during the opening of the container. A minimum face width of about 0.0025 inch to 0.0030 inch has been found preferable.

It is believed that the use of the present invention will be beneficial in scoring any bare or unlayered, laminated, layered or coated metal container wall wherein a layer or layers of a material having different flow characteristics than that of the material being scored is adhered to the scored material in substantial thickness. What is a substantial thickness would depend on the materials involved in a particular system. For example, the scoring of aluminum container ends with a thickness of 0.008 inch to 0.015 inch, and a protective coating of about 0.0002 inch thickness to a residual of about 0.004 inch with about 0.004 inch face width tool would appear to pose no particular difficulty to the prior art as represented by U.S. Pat. No. 3,688,718. However, when an aluminum container end of the same metallic thickness is adhered to a laminate structure of about 0.001 inch to 0.004 inch thickness, scoring to the same residual with the same width tool may result in the problems illustrated hereinabove in FIGS. 1 and 2. It is believed that a substantial thickness is that thickness which allows the metal flow below and about the primary score to be substantially non-uniform in a direction generally transverse to the score line, when scored with prior art indenters of the type described. In the particular situation of the illustrations hereinabove, the laminate allows metal to flow outward (toward the unrestrained container end periphery) and downward. It appears that by reducing the frictional forces between the scoring anvil and the end being scored, the laminate allows metal to extrude in the direction of least resistance toward the unrestrained periphery. It is believed that the application of a sufficient compressive force, such as by a secondary indenter, outboard of and sufficiently close to the primary score line will greatly reduce or obviate this tendency for non-uniform metal flow. Such metal flow is undesirable in that it can produce a score line of questionable integrity. It is believed that the compressive pressure should be applied no more than about 0.040 inch from the centerline of the primary score line and preferably no more than about 0.025 inch. It is also believed that the compressive pressure should be applied before a primary indenter has penetrated to about 50% of its ultimate penetration and to no more than 75% of the ultimate penetration of the primary indenter. Therefore, the present invention provides a method for scoring bare or unlayered, laminated, layered or coated container walls so that the score line has dependable integrity.

The present invention has the further advantage of extending the range of scoring parameters to narrower tools and lower residuals than the prior art permitted.

Figure 5:
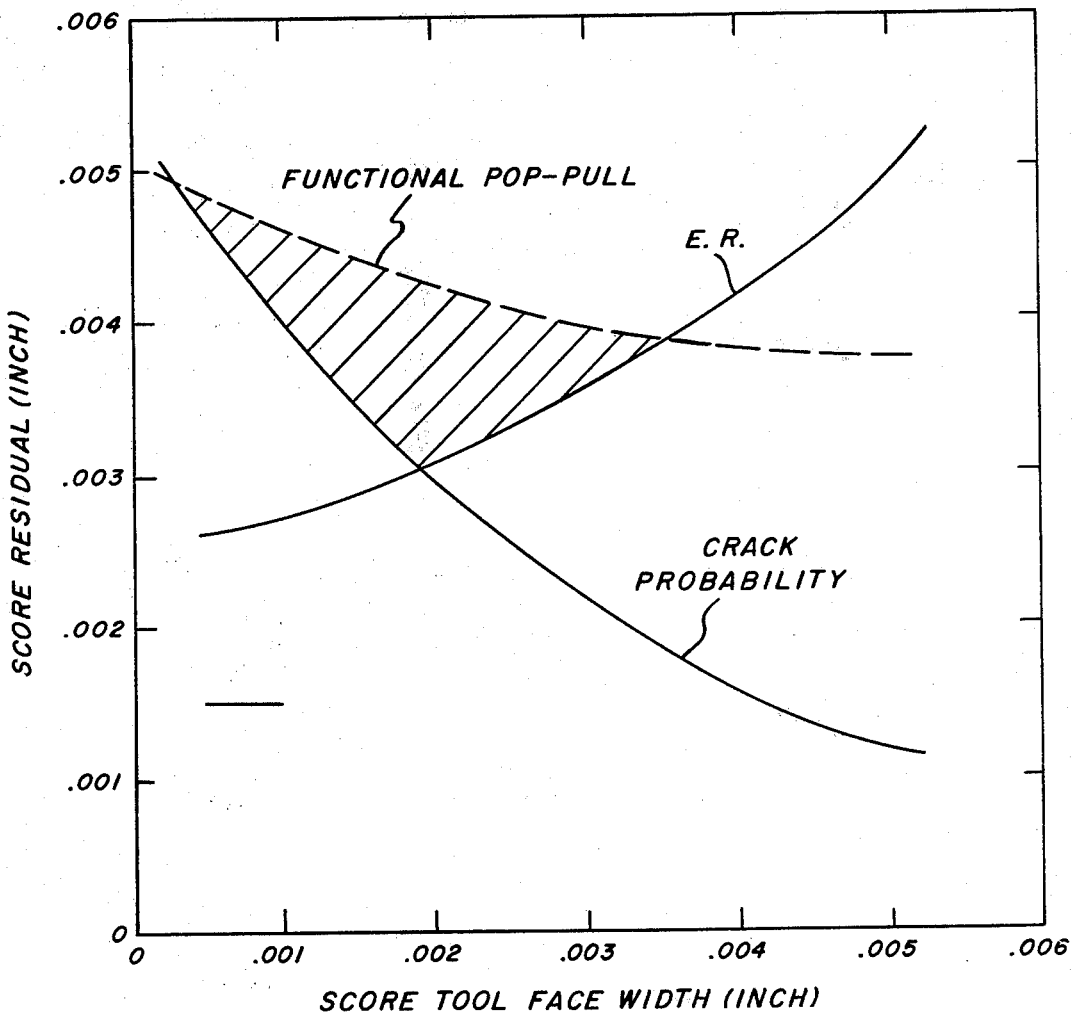
FIG. 5 is a number of plots of score residual versus score tool face width for various score evaluation parameters.

FIG. 5 illustrates how the various major scoring evaluation parameters define the acceptable range of score configurations for prior art scoring techniques. While the data in this figure were generated for non-repair coated 5052-H19 aluminum alloy ends it is believed that the trends observed are applicable to container wall scoring in general. The primary reason for scoring is to facilitate opening of the wall, and there is a maximum residual above which the amount of force to open the wall becomes objectionable. In FIG. 5, this upper limit is defined by the "functional pop-pull" curve. This curve defines those score residuals for given score widths below which the amount of force to initiate ("pop") or continue ("pull") fracture along the primary score line is acceptable. On the other hand, the lower the score line residual the greater the probability of cracks along the score line with a wider score tool face permitting a lower residual without cracking during scoring. This limitation is expressed in FIG. 5 by the "crack probability" curve. Thus, it would appear that to achieve low residuals and thereby facilitate ease of opening, a wide faced score tool should be utilized. However, in a non-repair coating system a wider tool increases the probability of damaging the coating. The coating integrity may conveniently be measured with a "Waco Enamel Rater" which essentially measures the electrical conductivity through the coating. The "E.R." curve in FIG. 5 indicates the minimum score residuals for various tool widths at which acceptable "enamel readings" or coating integrity is obtained. There is thus defined an area between the three curves in which all three evaluation parameters, coating integrity, structural integrity (cracking), and ease of opening, are all satisfied. Only those combinations of score residual and score tool face width falling within this area give satisfactory results when using prior art scoring techniques.

The use of the present invention greatly expands the range of scoring parameters which will yield satisfactory results. The horizontal bar in the lower left-hand corner of FIG. 5 illustrates certain scoring parameters employed with satisfactory results in the following example.

EXAMPLE I

Five non-repair coated full panel can ends of 5052-H19 aluminum alloy were scored to a residual of 0.0015 inch using a primary indenter circular in plan with two coextensive secondary indenters disposed on opposite sides of the primary score with centerlines spaced about 0.025 inch from that of the primary indenter. The secondary indenters had working face widths of about 0.0015 inch to 0.0020 inch while the primary indenter had an effective working face width of about 0.0005 inch to 0.0010 inch (in very narrow tool face widths the physical width of the tool may not be equivalent to the effective width, e.g. in this case while the primary indenter was essentially sharp it is felt that it had an effective face width in terms of the metal flow caused). All three indenters had included angles of about 50° between their side walls. The secondary indenters were so designed that they did not begin penetration of a container end until the primary indenter had achieved a penetration of about 0.0025 to 0.0030 inch. As all three indenters were carried on a common tool the secondary indenters achieved a penetration of about 0.0025 inch to 0.0030 inch less than that of the primary indenter which in these nominal 0.010 inch thick ends was less than about 65% of the ultimate penetration of the primary indenter. "Waco Enamel Rater" readings indicated that the coating was intact. The score line residual was found to be structurally sound.

This wide range of acceptable scoring parameters (score line width and residual thickness) is of advantage to the container end manufacturer in that these scoring parameters can be adjusted to accommodate other problems. For example, the prior art has indicated that in high speed commercial scoring of steel sheet metal a range of score residual thicknesses of 0.001 inch or greater is required to accommodate manufacturing tolerance. The use of the present invention would allow such a range while still meeting the three scoring evaluation criteria.

The flexibility of scoring techniques provided by the present invention has advantages even when coating integrity is not a requirement. For example, it has been found advantageous in scoring conventionally coated aluminum can ends for use with mildly corrosive media such as encountered in fish cans. Since conventional coatings are not expected to survive scoring, coating integrity is not a consideration. However, it has been found that a wide primary score is subject to corrosion and consequently microperforation. The use of the present invention alleviates this difficulty as shown in the following example.

EXAMPLE II

One hundred thirty-one varnished full panel pull-out ends of 5052-H19 aluminum alloy were tested with a citric acid sodium chloride solution (which acts as an accelerated simulation of the fish can environment). The criterion was the number of visible perforations after a 2 week exposure. Seventy-seven of the ends were scored by a single prior art indenter with a 0.0050 inch working face width. The remaining 54 ends were scored with the same tool as is described in Example I. All ends were scored to a residual 0.0035 inch. As the ends were conventionally coated with varnish the coating did not remain integral beneath the score trough. The ends were placed on containers containing the test solution, retorted for 20 minutes at 220°F and stored end down for 2 weeks at 75°F. The results were as follows:

| Score Profile | Visibly Perforated Ends/ Ends Tested |
|---|---|
| Conventional | 22 of 77 |
| Present Invention | 0 of 54 |

Figure 6:
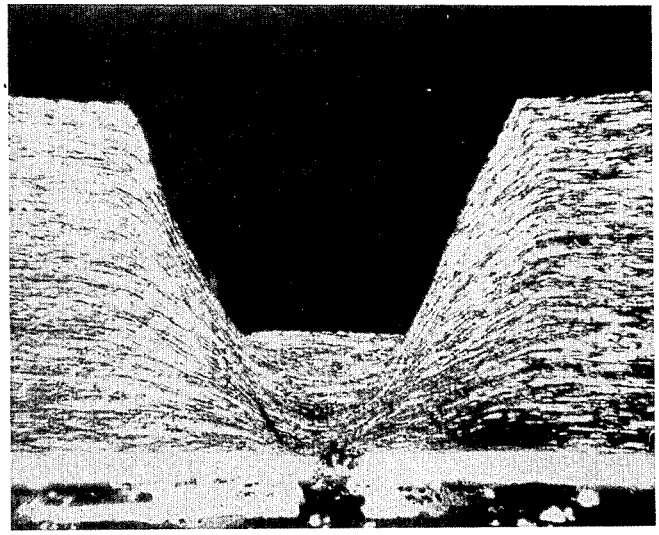
FIG. 6 PRIOR ART
FIG. 6 is a photomicrograph of a vertical section through a primary score line in a conventionally coated container end made with a single prior art indenter.

FIG. 6 shows the conventional score profile similar to that evaluated in Example II. A significant amount of metal flow was necessary to accommodate this wide score profile (a 0.005 inch tool was used). The grain lines beneath the score trough have been severely compressed and some have become discontinuous, terminating in the lower surface of the end. It is believed that these grain boundary lines have a different galvanic potential than the matrix which they bound. Thus, the fracturing of these grain boundary lines and the resulting simultaneous exposure of grain boundaries and matrix to the corrosive media sets up a galvanic couple between the grains and grain boundaries of the end. This galvanic action greatly accelerates the corrosion process and the fractured grain lines provide a convenient corrosion path.

The present invention provides for the alleviation of this problem by enabling scoring with a narrow tool to an acceptably low residual thereby minimizing the grain distortion. Reference to FIG. 5 indicates that the "present invention" combination of scoring parameters (0.0010 inch score width, 0.0035 inch score residual) used in Example II would result in cracking if prior art scoring were utilized.

It has been found that the same mechanism of metal flow control discussed hereinabove with reference to the laminated ends is operative and beneficial in the conventional and non-repair coated environments, and may also be beneficially employed in bare and unlayered container walls. The closely spaced secondary score lines provided by this invention restrain metal flow about the primary score trough especially in the direction of the unrestrained wall periphery. This restraint reduces the strain concentrations adjacent to the primary score trough and thus allows deeper scoring (lower residuals) with various types of scoring tools.

Scoring with a narrow indenter is somewhat analogous to splitting a log with a wedge. The present invention provides lateral compressive forces which restrict the splitting action engendered by scoring with a narrow tool.

Figure 7:
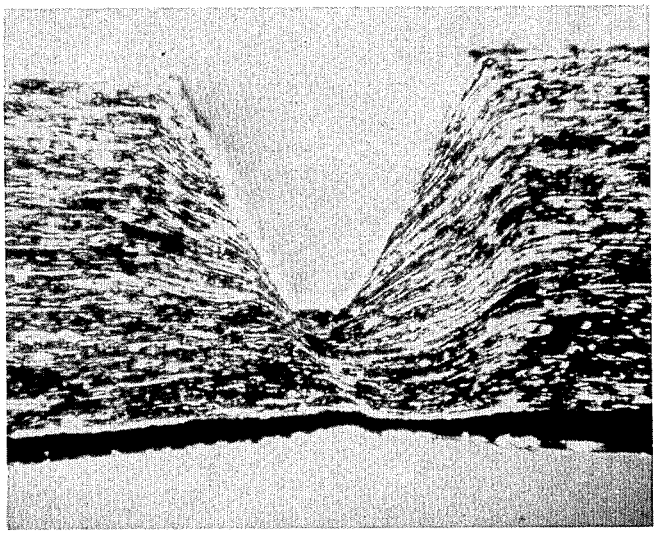
FIG. 7 is a photomicrograph of a vertical section through a primary score line in a non-repair coated container end made with a single prior art indenter.

FIG. 7 illustrates the metal flow produced in a non-repair coated end scored with a narrow score tool by conventional methods. A single indenter with a face width of about 0.0015 inch, typical for a non-repair coat tool, was used to score to a residual of about 0.0030 inch in a nominally 0.010 inch thick aluminum end. The chuck wall and periphery of the end are on the viewer's left. As in the case of the laminates, although less pronounced, there has been disproportionate metal flow toward the unrestrained wall periphery, the resulting concentration of strain below the outboard corner of the score trough greatly enhanced the probability of cracking, and in this particular case fracture actually occurred during scoring.

Figure 8:
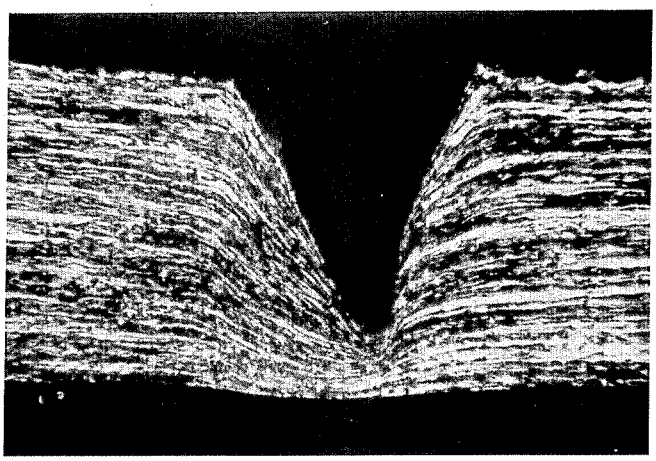
FIG. 8 is a photomicrograph of a vertical section through a primary score line in a non-repair coated container end made with the present invention using a narrow primary indenter.

In FIG. 8, the metal flow utilizing the present invention on a non-repair coated aluminum end is displayed. The tooling described in Example II was used to score to a residual of about 0.0015 inch. There has been no appreciable unsymmetric metal flow, no metal fracture and no strain concentration has occurred.

Figure 9:
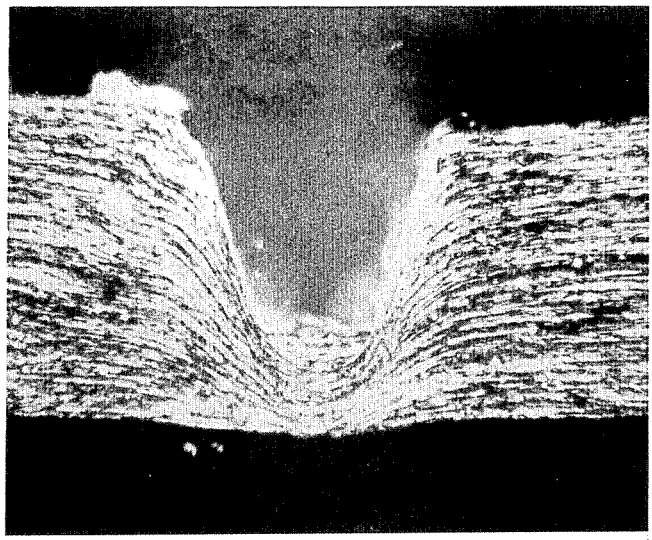
FIG. 9 is a photomicrograph of a vertical section through a primary score line in a non-repair coated container end made with the present invention using a wider primary indenter than used in FIG. 8.

The same favorable metal flow is displayed in FIG. 9 wherein an about 0.0035 inch width primary indenter was used to score to an about 0.0040 inch residual in a nominally 0.010 inch thick aluminum end. Two secondary indenters were coextensive with and spaced with centerlines about 0.025 inch from the centerline of the primary indenter. These secondary indenters began penetration after the primary indenter had achieved a penetration of about 0.0025 inch to 0.0030 inch.

An important feature of the present invention is the restraint on metal flow away from the primary score, especially toward the container wall periphery. The chuck wall at the periphery of a can, for example, appears to offer little resistance to radially outward metal flow whereas in any closed or semi-closed score configuration metal flow from the score inward works against itself much like the compression of a diaphragm from its periphery inward. Therefore, it will be appreciated that the present invention will improve scoring behavior not only in full panel ends but in any case in which the score configuration is closed or semi-closed such as keyhole beverage container end scoring.

Whereas particular embodiments of the invention have been described above for purposes of illustration, it will be evident to those skilled in the art that numerous variations of the details may be made without departing from the invention as described in the appended claims.

I claim:

1. A tool for scoring a metallic container wall comprising a primary indenter;

a secondary indenter substantially coextensive with said primary indenter and positioned between said primary indenter and the periphery of said tool;

said tooling configuration being so designed that upon indentation of a container wall said secondary indenter will not penetrate the container wall until said primary indenter has achieved at least one-quarter of its ultimate penetration but before said primary indenter has achieved about one-half of its utimate penetration.

2. A tool as described in claim 1 wherein the centerline of said secondary indenter is spaced no more than 0.040 inch from the centerline of said primary indenter.

3. A tool as described in claim 2 wherein a second secondary indenter is so positioned that said primary indenter lies between said second secondary indenter and a first secondary indenter which is positioned between said primary indenter and the periphery of said tool and wherein the centerline of said secondary indenter is substantially coextensive with and spaced no more than about 0.040 inch from the centerline of said primary indenter.

4. A tool as described in claim 2 wherein the face width of said primary indenter is no more than about 0.002 inch.

5. A metallic container wall comprising a removable sector having an integral opening device;

a primary score line defining said removable sector; and a secondary score line substantially coextensive with said primary score line having a depth of no more than about 75% of that of said primary score line and located between said primary score line and the periphery of said removable panel with its centerline no more than about 0.040 inch from the centerline of said primary score line whereby said primary score line may be deep and narrow and yet have dependable integrity.

6. The container wall of claim 5 wherein at least one layer of a substantial thickness of material with different flow characteristics than those of the metal of the container wall is adhered thereto.

7. The container wall of claim 5 wherein said primary score line has a width of no more than about 0.002 inch.

8. The container wall of claim 7 wherein said primary score line has a residual of no more than about 0.0030 inch.

9. The container wall of claim 5 wherein the metal distribution in the region beneath and closely adjacent to said primary score line is substantially symmetric with respect to the centerline of said score line.

* * * * *